US005826872A

United States Patent [19]

Hall

[11] Patent Number: 5,826,872

[45] Date of Patent: Oct. 27, 1998

[54] SPHERICAL PUZZLE GAME AND METHOD

[76] Inventor: Albert J. Hall, 2985 SW. 136th Ave., Davie, Fla. 33330

[21] Appl. No.: 942,911

[22] Filed: Oct. 2, 1997

[51] Int. Cl.[6] ..... A63F 9/08

[52] U.S. Cl. ..... 273/156; 446/126

[58] Field of Search ..... 273/153 R, 156, 273/153 S; 473/594, 577, 614; 446/901, 124, 125, 126

[56] References Cited

U.S. PATENT DOCUMENTS

| | | | |
|---|---|---|---|
| 3,008,719 | 11/1961 | Misko | 473/594 |
| 5,127,652 | 7/1992 | Unger . | |
| 5,199,716 | 4/1993 | DeFluiter et al. | 473/572 |
| 5,340,349 | 8/1994 | Berg-Fernstrum | 446/901 |
| 5,411,262 | 5/1995 | Smith . | |

FOREIGN PATENT DOCUMENTS

| | | | |
|---|---|---|---|
| 295787 | 12/1988 | European Pat. Off. | 446/125 |

*Primary Examiner*—Steven Wong

*Attorney, Agent, or Firm*—Malin, Haley, DiMaggio & Crosby, PA

[57] ABSTRACT

A toy puzzle including a plurality of individual pieces that can be assembled into a geometrically solid shape, such as spherical, is provided. In one embodiment, the individual pieces can include a truncated conical base member with a central spindle protruding perpendicularly from the center of the base. The pieces can have truncated conical base members of the same or different sizes. The spindle has metal in at least the end opposite the base that is attracted and held by a magnet. Upon assembly of the plurality of individual pieces, the magnet will be disposed at the center of a resulting object of preselected shape.

7 Claims, 6 Drawing Sheets

SPHERICAL PUZZLE GAME AND METHOD

BACKGROUND OF THE INVENTION

1. Field of the Invention

This invention relates to puzzles and toys, and more particularly to puzzles and toys that include individual pieces that can be joined together to form a three-dimensional object.

2. Description of Related Art

Puzzle solvers enjoy the challenge of puzzles that require some manual dexterity and skill to solve. Puzzles of the type which are comprised of a plurality of individual parts that are held together by magnets to form various shaped objects are known in the art.

U.S. Pat. No. 5,127,652, to Unger, discloses a toy of various geometrically solid shapes that can break into a plurality of individual pieces by prying or throwing against a hard object. The individual pieces of the toy each contain a plurality of magnets placed in preselected locations to enable the user to reassemble the toy into the solid shape. As disclosed in the '652 patent, the positioning and installation of the magnets into each individual piece requires some forethought and testing. The pre-planning and testing necessary to position the magnets can add to the complexity and cost of the manufacturing process.

U.S. Pat. No. 5,411,262, to Smith, discloses a plurality of essentially two dimensional pieces that can be assembled to form a hollow three-dimensional object. Each individual piece has at least three edges and includes a magnet attached to each edge for joining together with adjacent pieces. The orientation of the north and south poles of the magnets is important for reassembly of the object, and must be pre-planned before manufacturing can begin.

There is always the need for new and challenging puzzle for the puzzle solver. There is a further need for the puzzle to be educational for children by teaching problem solving skills and manual dexterity. In addition, there is always a need for puzzles that are quickly and easily manufactured, and that are sturdy and reasonably priced.

SUMMARY OF THE INVENTION

The present invention provides a toy puzzle including a plurality of individual pieces that can be assembled into a geometrically solid shape, such as spherical. The individual pieces are each identical and can include a truncated conical base member with a central spindle protruding perpendicular from the center of the base. The spindle has metal in at least the end opposite the base that is attracted and held by a single magnet. Upon assembly of the plurality of individual pieces, the magnet will be disposed at the center of the resulting spherical shaped object.

Assembly of a spherical shaped object using a single central magnet and a plurality of individual pieces that radiate outward from the magnet and end in a truncated conical base member requires some patience, skill, and manual dexterity.

Because the plurality of individual pieces can be identical, and only one central magnet is required, the toy is easily and quickly manufactured. In an alternate embodiment, the individual pieces consist of pieces with different sized base members. However, the toy is still easily and quickly manufactured because the pieces are all uniform.

Accordingly, it is an object of the present invention to provide a puzzle that presents an enjoyable challenge for the puzzle solver.

It is a further objective of the present invention to provide a puzzle that includes a plurality of pieces that combine together by a single magnet to form a spherical shaped object.

It is still a further objective of the present invention to provide a puzzle that requires some level of problem solving skill and manual dexterity to assemble, and which is educational for children by teaching these skills.

In accordance with these and other objects which will become apparent hereinafter, the instant invention will now be described with particular reference to the accompanying drawings.

DESCRIPTION OF THE PREFERRED EMBODIMENT

Figure 1:
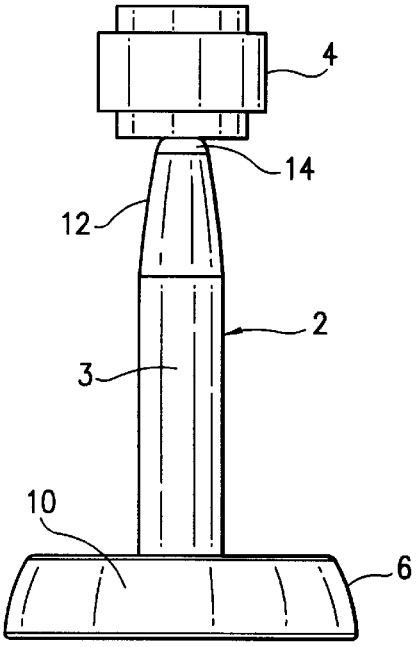
FIG. 1 is front elevational view of one of the plurality of individual pieces and the magnet of a first embodiment of the present invention.
Figure 2:
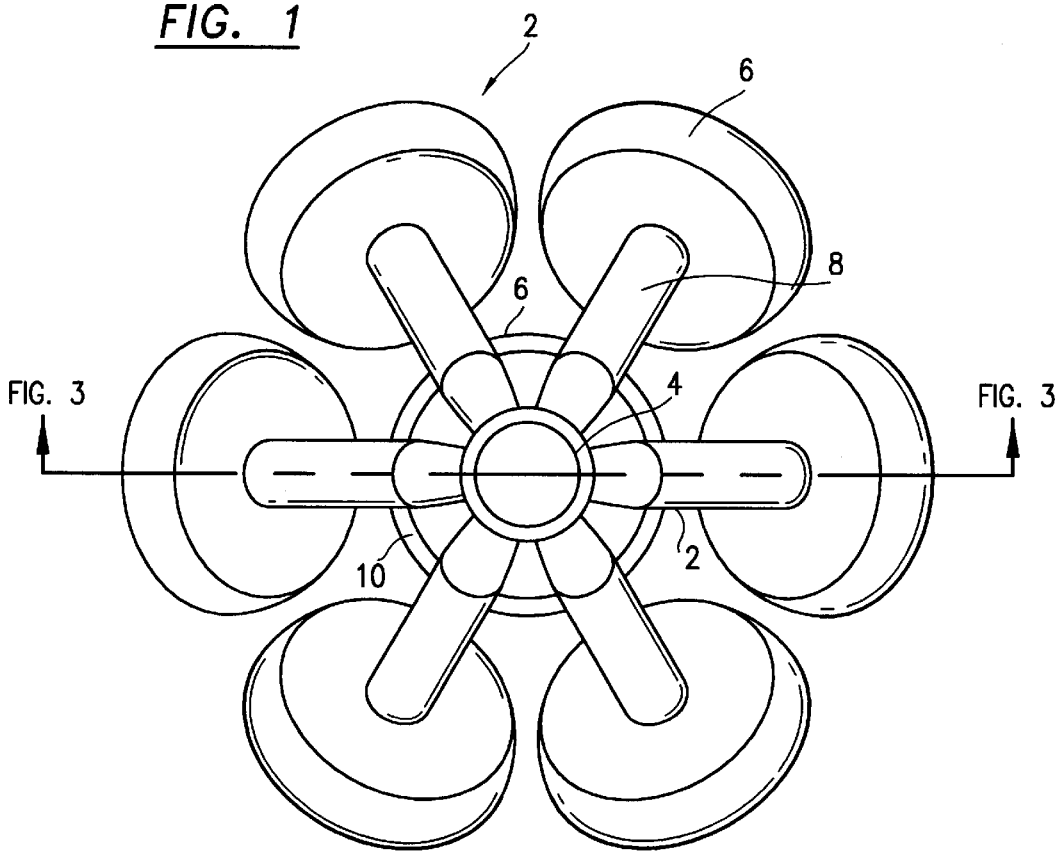
FIG. 2 is a top plan view of the embodiment of FIG. 1, illustrated partially assembled.

Referring to FIG. 1, a first embodiment of the present invention utilizes a plurality of identical puzzle pieces 2, and a single central magnet 4. FIG. 1 illustrates a single puzzle piece 2 magnetically attached to magnet 4. FIG. 2 illustrates a top plan view of the first embodiment partially assembled showing six (6) identical puzzle pieces 2 magnetically attached to magnet 4. Magnet 4 can be a single magnet or a combination of a plurality of individual magnets, which may be disc shaped and magnetically connected together to form a single contiguous magnet.

Each puzzle piece 2 includes a truncated conical base member 6 of a predetermined diameter and thickness. The axis of the truncated cone is aligned coaxially with a shaft or spindle member 8 of predetermined length that forms the radius of the resulting spherical toy. As described herein below, a preselected number of pieces 2 are required, with a preselected radius or spindle member 8 length and base member 6 diameter, to form the resultant sphere.

Spindle member 8 can be a somewhat elongated member, such as a shaft, tube, or bar of circular or non-circular cross-section, that extends substantially perpendicularly from the center of base member 6. Base member 6 includes a beveled surface 10 extending circumferentially around base 6. Spindle member 8 can include beveled end 12, and metal tip 14 for attraction to magnet 4.

Figure 3:
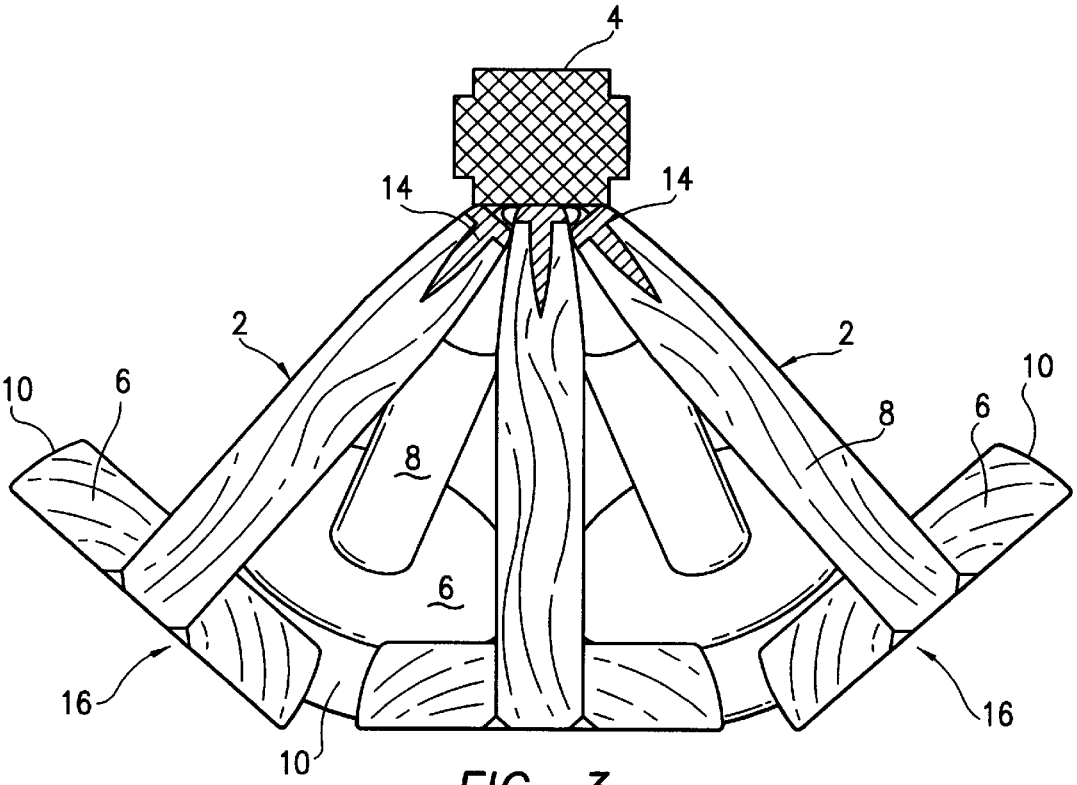
FIG. 3 is a front elevational sectional view, taken along line 3—3 in FIG. 2.

Referring to FIGS. 2 and 3, six (6) puzzle pieces 2 are illustrated magnetically attached to magnet 4 as the puzzle is being assembled. (Five (5) puzzle pieces 2 are illustrated in FIG. 3). Beveled surfaces 10 and 12 are appropriately selected to closely accommodate the plurality of adjacent puzzle pieces 2 as the sphere 20 is assembled.

Puzzle piece 2 can be made of any suitable material such as wood, plastic, metal, and the like. In one embodiment, puzzle piece 2 can be made of wood. Base member 6 can be through-bored resulting in aperture 16, and sized to received spindle member 8 which can be pressed and glued into aperture 16 in base 6. Metal tip 14 can be a metal fastener that can be inserted or screwed into the end of spindle member 8 opposite base member 6, as illustrated in FIG. 3.

As more and more puzzle pieces 2 are added to magnet 4, skill and dexterity is required to hold the growing spherical shaped object while simultaneously adding puzzle pieces 2.

Figure 4:
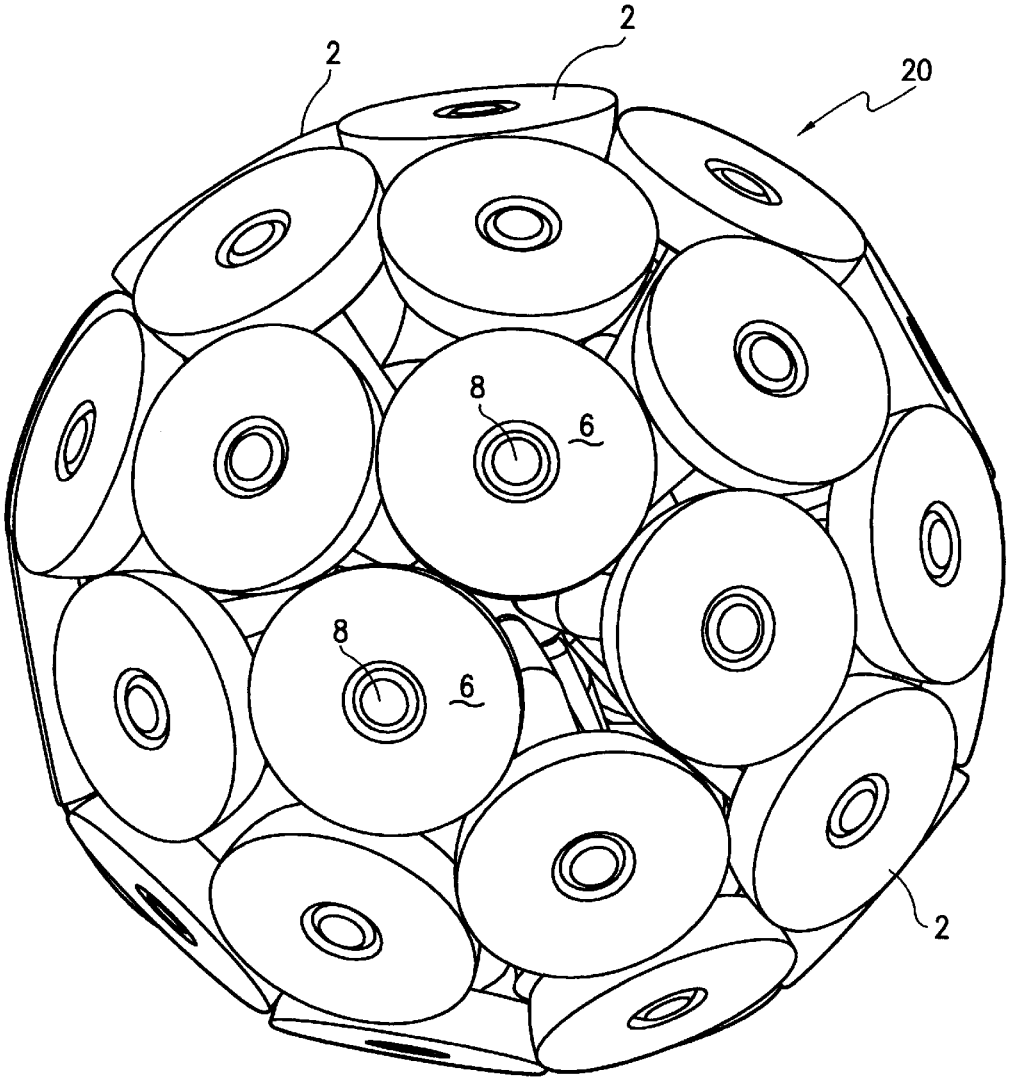
FIG. 4 is a perspective view of a first embodiment of the present invention shown assembled.

Referring to FIG. 4, when all the puzzle pieces 2 have been attached magnetically to magnet 4, spherical toy 20 is formed. As illustrated in FIG. 1, magnet 4 can have a somewhat irregular shape, and does not itself need to be spherical or rounded to assemble the puzzle. Once formed, the puzzle toy 20 can be broken down into individual puzzle pieces 2 for another reassembly.

Because puzzle pieces 2 are all identical in the first embodiment of the invention discussed herein above, and only one magnet is needed, the toy can be easily, quickly, and inexpensively manufactured.

The size of the puzzle pieces 2, and resultant size of puzzle 20 can be preselected to nearly any desired sizes. The ratio of the sizes of base member 6, spindle length 8, and magnet 4 is important so that assembly will result in a spherical shaped object.

In one embodiment, there are 38 individual puzzle pieces 2. Each puzzle piece 2 includes a base member 6 with a maximum diameter of approximately 5.5 cm, and a spindle member 8 total length of approximately 7.6 cm. Magnet 4 is approximately just slightly over 2 cm in diameter. The above dimensions result in a spherical object 20 having a radius of approximately 8.6 cm.

To determine alternate dimensions for the individual puzzle pieces 2 and sphere 20, the equations for the surface area of a sphere ($4\pi R_1^2$) and for the area of a circle ($\pi R_2^2$), where $R_1$ is the radius of the sphere 20 and $R_2$ is the radius of base member 6, can be utilized. Using these equations and the dimensions given herein above for one embodiment of the invention, it is simply a mathematical problem to calculate that 38 individual pieces will be required to complete the sphere.

The calculations can be used to determine the approximate number of circles of a given radius that will be required to fill the surface area of a sphere of given radius. The size of sphere 20 and the size and number of individual puzzle pieces 2 can be varied, according to the desires of the puzzle builder, by varying the parameters of the equations.

The assembled puzzle sphere 20, as illustrated in FIG. 4, includes spaces between adjacent base members 6 on the surface of sphere 20. A second embodiment of the present invention includes puzzle pieces 2 that have two different size base members 6 that results in a reduction of the void areas on the spherical surface between adjacent base members 6. In the following description of the second embodiment of the present invention, elements that are identical to elements of the first embodiment 20 have the same reference numbers.

Figure 5:
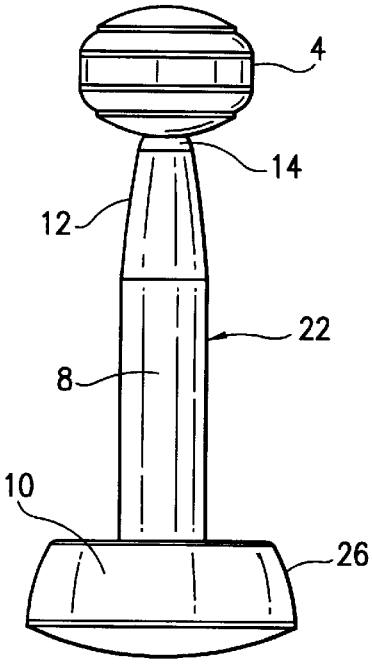
FIG. 5 is front elevational view of one of the plurality of individual pieces and the magnet of a second embodiment of the present invention.

Referring to FIG. 5, puzzle piece 22 is illustrated attached to magnet 4. As discussed herein above, magnet 4 can be a single magnet or a combination of a plurality of individual magnets. Puzzle piece 22 includes spindle member 8 and truncated conical base member 26. Utilizing the example herein above in which puzzle piece 2 includes base member 6 having a maximum diameter of approximately 5.5 cm, base member 26 can have a maximum diameter of approximately 4 cm. Spindle member 8 will retain a total length of approximately 7.6 cm.

Figure 6:
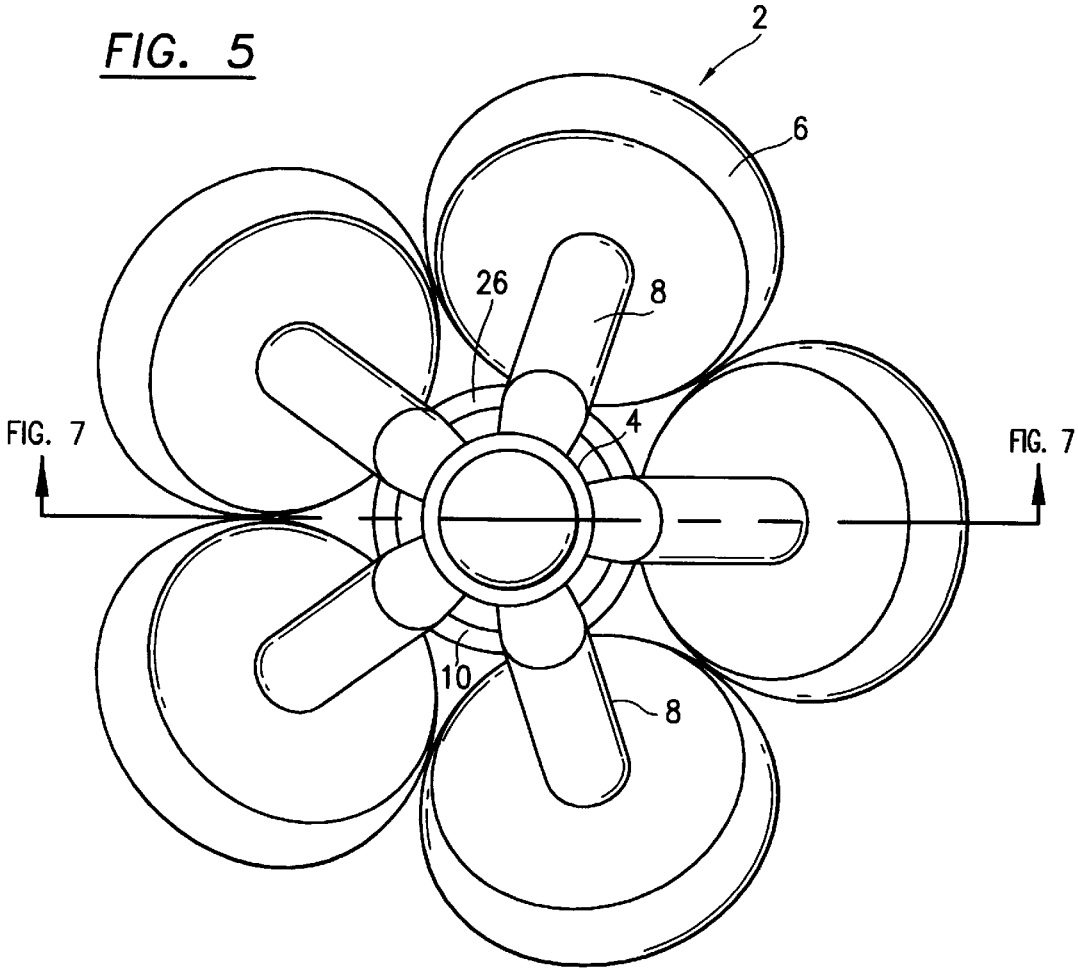
FIG. 6 is a top plan view of the embodiment of FIG. 5, illustrated partially assembled.
Figure 7:
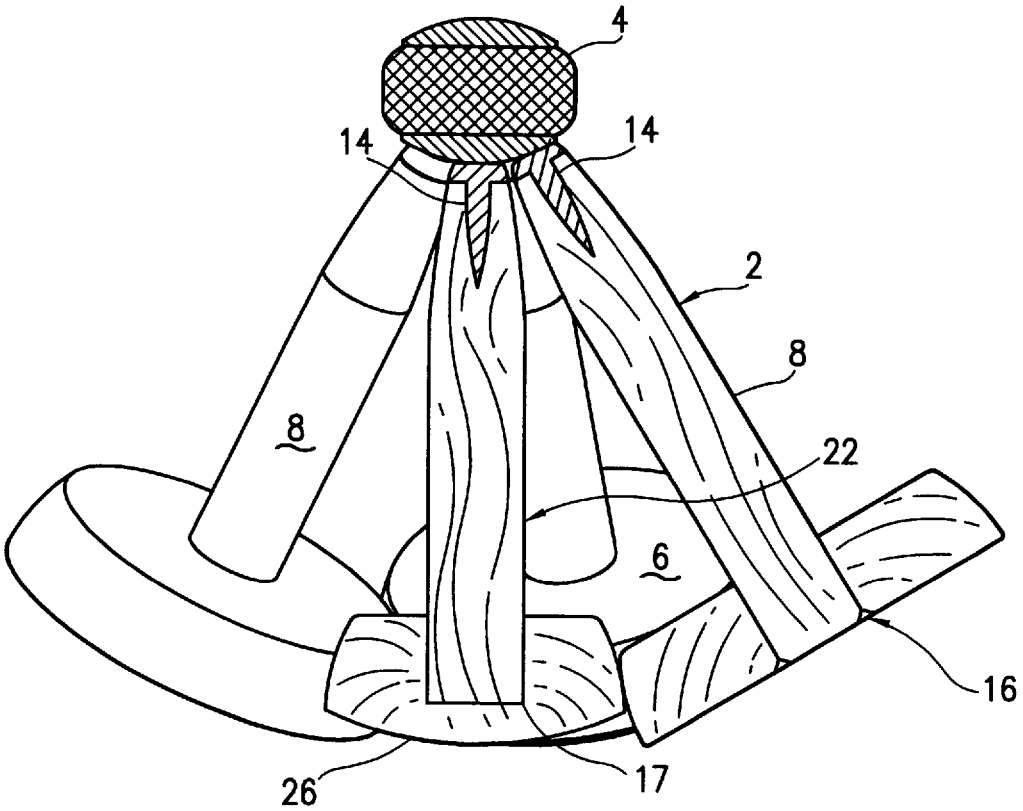
FIG. 7 is a front elevational sectional view, taken along line 7—7 in FIG. 6.

Referring to FIGS. 6 and 7, puzzle piece 22 is illustrated attached by spindle 8 to magnet 4, and surrounded by five (5) puzzle pieces 2 also attached by spindle 8 to magnet 4. As shown in FIGS. 6 and 7, base member 26 is smaller than base member 6, and substantially fills the void defined by five (5) base members 6 that are side-by-side adjacent each other with attached spindles 8 connected to magnet 4.

As illustrated in FIG. 7, base member 26 can be partially through-bored 17 to receive spindle member 8. Base member 26 can alternately be through-bored in similar manner to base member 6, and base member 6 can be partially through-bored to receive spindle member 8. Spindle member 8 thus can be attached to base members 6 and/or base members 26 in any suitable manner, including pressed, glued, screwed, bolted, or being made together with the base member as an integral part thereof.

FIG. 6 illustrates the initial phase of the solution, or method to correctly assemble the second embodiment of the invention. As stated above, the initial phase comprises attachment of one (1) piece 22, and five (5) pieces 2 to magnet 4. The remainder of the method includes sequentially and symmetrically building the sphere by adding the following: a) attachment of five (5) pieces 2 to magnet 4; b) attachment of five (5) pieces 22; c) attachment of ten (10) pieces 2; d) five (5) pieces 22 are then arranged around and positioned onto the ten (10) pieces 2, with each piece 22 adjacent or in-line with one of the five (5) previously attached puzzle pieces 22; e) attachment of five (5) larger pieces 2; f) attachment of five (5) larger pieces 2; and, g) attachment of the final piece 22.

Figure 8:
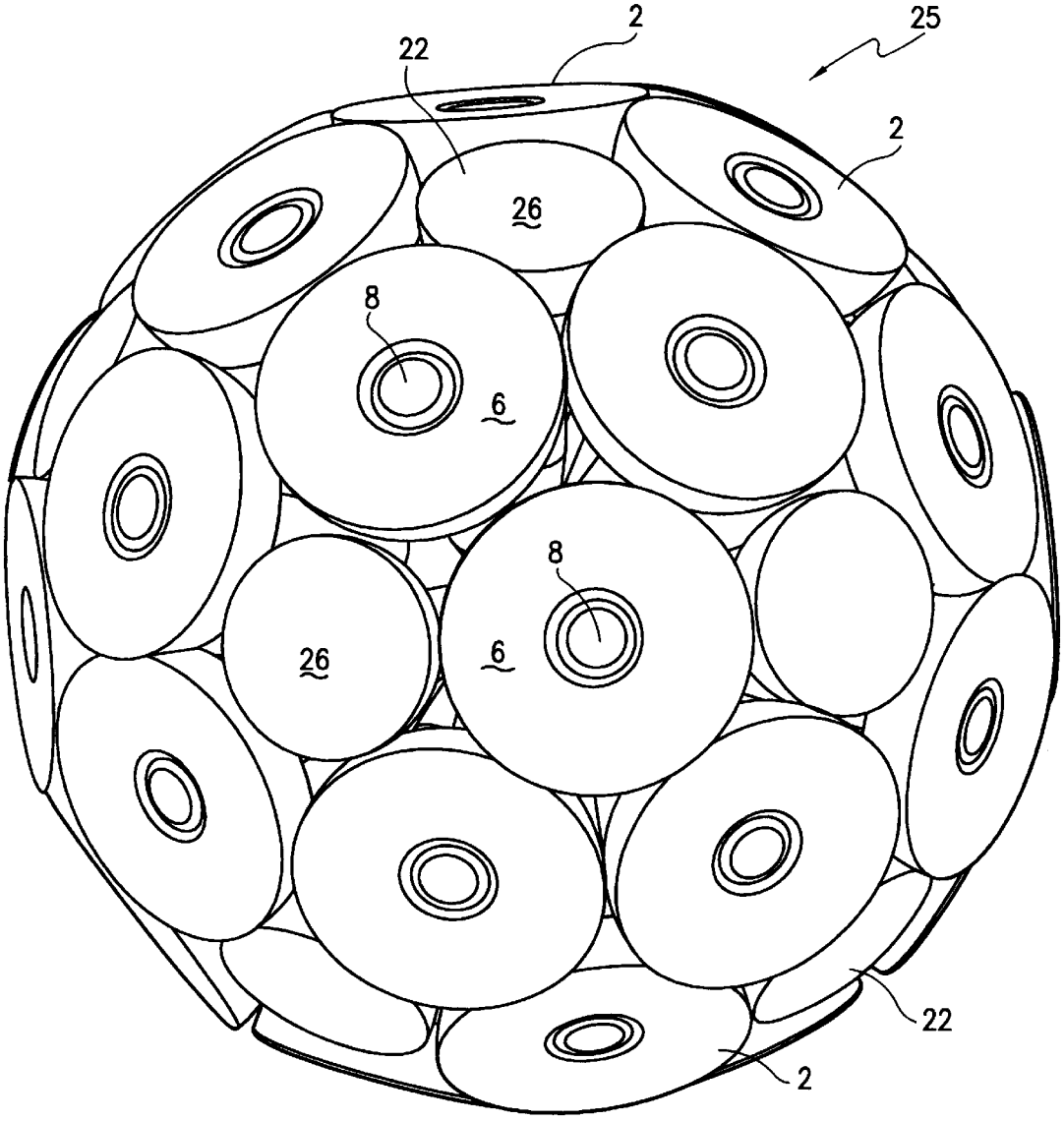
FIG. 8 is a perspective view of a second embodiment of the present invention shown assembled.

Referring to FIG. 8, the second embodiment of the present invention 25 includes 12 pieces 22 with smaller bases 26, and 30 pieces 2 with larger bases 6 for a total of 42 puzzle pieces. Utilizing the two sizes of base members 2 and 22 results in a sphere 25 having minimum space between bases 6 and 26. Because the puzzle pieces 2 and 22 are uniform and include identical spindle members 8, puzzle 25 is easy and inexpensive to manufacture.

In addition, while a spherical shaped puzzle 20 or 25, utilizing puzzle pieces 2 and/or 22 having truncated conical base members 6 or 26, are the preferred embodiments, alternate embodiments are possible and considered to fall within the scope of the present invention. For example, a spherical puzzle 20 utilizing puzzle pieces 2 having base members 6 with other shapes, such as pentagonal, hexagonal, and the like, is contemplated. In addition, the assembled puzzle 20 could result in a geometric solid shape other than spherical.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A puzzle comprising:

a plurality of individual puzzle pieces, each puzzle piece having a base member of a predetermined shape, said shape being a truncated cone having a beveled surface disposed on an outer circular perimeter, and an elongated spindle member disposed substantially perpendicular to a center of said base member, said spindle member having at least a portion being metal disposed at an end distal from said base member, and further including a beveled surface adjacent said metal portion;

a magnet for magnetically capturing each of said plurality of individual puzzle pieces, said metal portion of each of said spindle members being magnetically connectable to said magnet, each of said base members being distal to said magnet and adjacent each other for forming a preselected three-dimensional shape, wherein said preselected three-dimensional shape is a sphere.

2. The puzzle of claim 1 wherein each of said puzzle pieces are made of wood and said metal portion of each of said spindle members is a metal fastener.

3. The puzzle of claim 1 wherein each of said base members are substantially the same size.

4. The puzzle of claim 3 wherein there are thirty-eight (38) individual pieces.

5. The puzzle of claim 1 wherein said plurality of individual pieces includes a first plurality having said base members of a first size and a second plurality having said base members of a second size.

6. The puzzle of claim 5 wherein twelve (12) of said individual pieces have said base members of said first size and thirty (30) of said individual pieces have said base members of said second size, wherein said second size is larger than said first size.

7. A method of puzzle solution for a puzzle of the type having:

twelve individual first pieces each having a base member of a predetermined shape, said shape being a truncated cone having a beveled surface disposed on an outer circular perimeter, and of a first size, and an elongated spindle member disposed substantially perpendicular to a center of said base member, said spindle member having at least a portion being metal disposed at an end distal from said base member, and further including a beveled surface adjacent said metal portion;

thirty individual second pieces each having a base member of a predetermined shape, said shape being a truncated cone having a beveled surface disposed on an outer circular perimeter, and of a second size, and one of said elongated spindle members disposed substantially perpendicular to a center of said base member, said spindle member having at least a portion being metal disposed at an end distal from said base member, and further including a beveled surface adjacent said metal portion; and a magnet for magnetically capturing each of said puzzle pieces, said metal portion of each of said spindle members being magnetically connectable to said magnet, each of said base members being distal to said magnet and adjacent each other for forming a preselected three-dimensional shape, wherein said preselected three-dimensional share is a sphere;

said method comprising the steps of:

a) connecting one of said first pieces to said magnet at said metal portion of said spindle member;

b) connecting five of said second pieces to said magnet at said metal portion of said spindles, said base members of said second pieces being symmetrical to said magnet and adjacent said base member of said first piece;

c) connecting five of said second pieces to said magnet at said metal portion of said spindles, said base members of said second pieces being symmetrical to said magnet and adjacent said second pieces connected in step b);

d) connecting five of said first pieces to said magnet at said metal portion of said spindles, said base members of said first pieces being symmetrical to said magnet and adjacent said second pieces connected in step c);

e) connecting ten of said second pieces to said magnet at said metal portion of said spindles, said base members of said second pieces being symmetrical to said magnet and adjacent each other and said first pieces connected in step d);

f) connecting five first pieces to said magnet at said metal portion of said spindles, said base members of said first pieces being symmetrical to said magnet, adjacent to said second pieces connected in step e) and in-line with said first pieces connected in step d);

g) connecting five of said second pieces to said magnet at said metal portion of said spindles, said base members of said second pieces being symmetrical to said magnet and adjacent said first pieces connected in step f);

h) connecting five of said second pieces to said magnet at said metal portion of said spindles, said base members of said second pieces being symmetrical to said magnet and adjacent said second pieces connected in step g);

i) connecting one of said first pieces to said magnet at said metal portion of said spindles and adjacent to said second pieces connected in step h) resulting in an assembled substantially spherically shaped puzzle.

* * * * *